US007971376B2

(12) United States Patent
Tsao

(10) Patent No.: US 7,971,376 B2
(45) Date of Patent: Jul. 5, 2011

(54) ROCKING HEAD PICTURE DISPLAY DEVICE

(76) Inventor: Chien-Hsun Tsao, Taipei County (TW)

( * ) Notice: Subject to any disclaimer, the term of this patent is extended or adjusted under 35 U.S.C. 154(b) by 284 days.

(21) Appl. No.: 12/413,215

(22) Filed: Mar. 27, 2009

(65) Prior Publication Data

US 2009/0183402 A1 Jul. 23, 2009

Related U.S. Application Data

(63) Continuation-in-part of application No. 11/758,071, filed on Jun. 5, 2007, now abandoned.

(51) Int. Cl.
*A63H 3/20* (2006.01)

(52) U.S. Cl. ..... 40/423; 40/614; 40/455; 40/421; 446/330

(58) Field of Classification Search ..... 40/411, 40/414, 421, 423, 529, 430; 446/330, 338, 446/353; 318/128; 452/166
See application file for complete search history.

(56) References Cited

U.S. PATENT DOCUMENTS 1,650,630 A * 11/1927 Klein ..... 40/455
2,638,693 A * 5/1953 Foster ..... 40/789
2,781,462 A * 2/1957 Wheeler et al. ..... 310/32
2,817,916 A * 12/1957 Allen et al. ..... 40/614
3,270,450 A * 9/1966 Flum ..... 40/421
3,325,759 A * 6/1967 Ito ..... 335/229
3,474,314 A * 10/1969 Ito ..... 318/128
3,757,458 A * 9/1973 Thorn ..... 446/378
4,073,088 A * 2/1978 Beny et al. ..... 446/354
4,616,380 A * 10/1986 Tieleman ..... 452/166
6,524,158 B1 * 2/2003 Fong ..... 446/330
7,063,588 B2 * 6/2006 Kaneko et al. ..... 446/129
7,318,766 B2 * 1/2008 Marine et al. ..... 446/359

* cited by examiner

*Primary Examiner* — Joanne Silbermann
*Assistant Examiner* — Shin Kim

(57) ABSTRACT

A rocking head picture display device includes a casing and a rocking assembly received in the casing. The rocking device includes an electromagnetic device mounted to the bottom of the casing and a rocking device mounted to the top of the casing. The rocking device includes a pivotal shaft supported by the casing and a rocking arm extending downward next to the electromagnetic device. A circular plate shaped connector is eccentrically joined to the outer end of the pivotal shaft in front of the casing. A channel shaped base is joined to bottom of the casing to form a locating groove. A picture has a head portion adhered to the connector and a body portion rested in the locating groove. When the electromagnetic device is powered on, the rocking device is induced to swing with the connector and the head portion.

2 Claims, 8 Drawing Sheets

ROCKING HEAD PICTURE DISPLAY DEVICE

The application is a continuation-in-part of application Ser. No. 11/758,071 filed on Jun. 5, 2007 now abandoned.

BACKGROUND OF THE INVENTION

1. Field of the Invention

The present invention relates to a picture display device, and more particularly to a rocking head picture display device.

2. Description of Related Art

The conventional rocking head picture display device in accordance with the prior art shown in FIG. 1 comprises a rocking device (1) and a picture (2) attached to the rocking device (1). The rocking device (1) includes a body (12) and a rocking element (11) pivotally mounted in the rocking device (1) and extending through a top of the rocking device (1). The rocking element (11) has a free end swings relative to the rocking device (1) due to actuation of an electromagnetic element (not shown) when the rocking device (1) is powered on. A connector (13) is attached to the free end of the rocking element (11). The picture (2) is divided into a body portion (21) adhered to the body (12) of the rocking device (1) and a head portion (22) adhered to the connector (13) such that the body portion (21) is parallel to the head portion (22). As a result, the head portion (22) swings in accordance with the rocking device (1) being induced to move by the electromagnetic element.

However, the connector (13) is attached to the free end of the rocking element (11) such that the rocking element (11) is easily broken when being packaged or delivered. In addition, the body portion (21) and the head portion (22) are adhered to the body (12) of the rocking device (1) and the connector (13) respectively such that the body portion (21) and the head portion (22) are difficult to be detached from the rocking device (1) and replaced.

The present invention has arisen to mitigate and/or obviate the disadvantages of the conventional rocking head picture display device.

SUMMARY OF THE INVENTION

The main objective of the present invention is to provide an improved rocking head picture display device that is a convenient design and makes the picture more vivid.

To achieve the objective the picture display device in accordance with the present invention comprises a hollow casing with a bottom and a rocking assembly received in the casing. The rocking assembly includes an electromagnetic device mounted to the bottom of the casing and a rocking device mounted to the top of the casing. The rocking device corresponds to the electromagnetic device. The rocking device includes a pivotal shaft supported by the casing and a rocking arm corresponding to the electromagnetic device. A plate shaped connector is joined to the end of the pivotal shaft extending outward the front side of the casing. A base is attached to outer side of the bottom of the casing. A picture has a head portion adhered to the connector and a body portion rest in a locating groove between the base and the front side of the casing.

Further benefits and advantages of the present invention will become apparent after a careful reading of the detailed description with appropriate reference to the accompanying drawings.

DETAILED DESCRIPTION OF THE INVENTION

Figure 1:
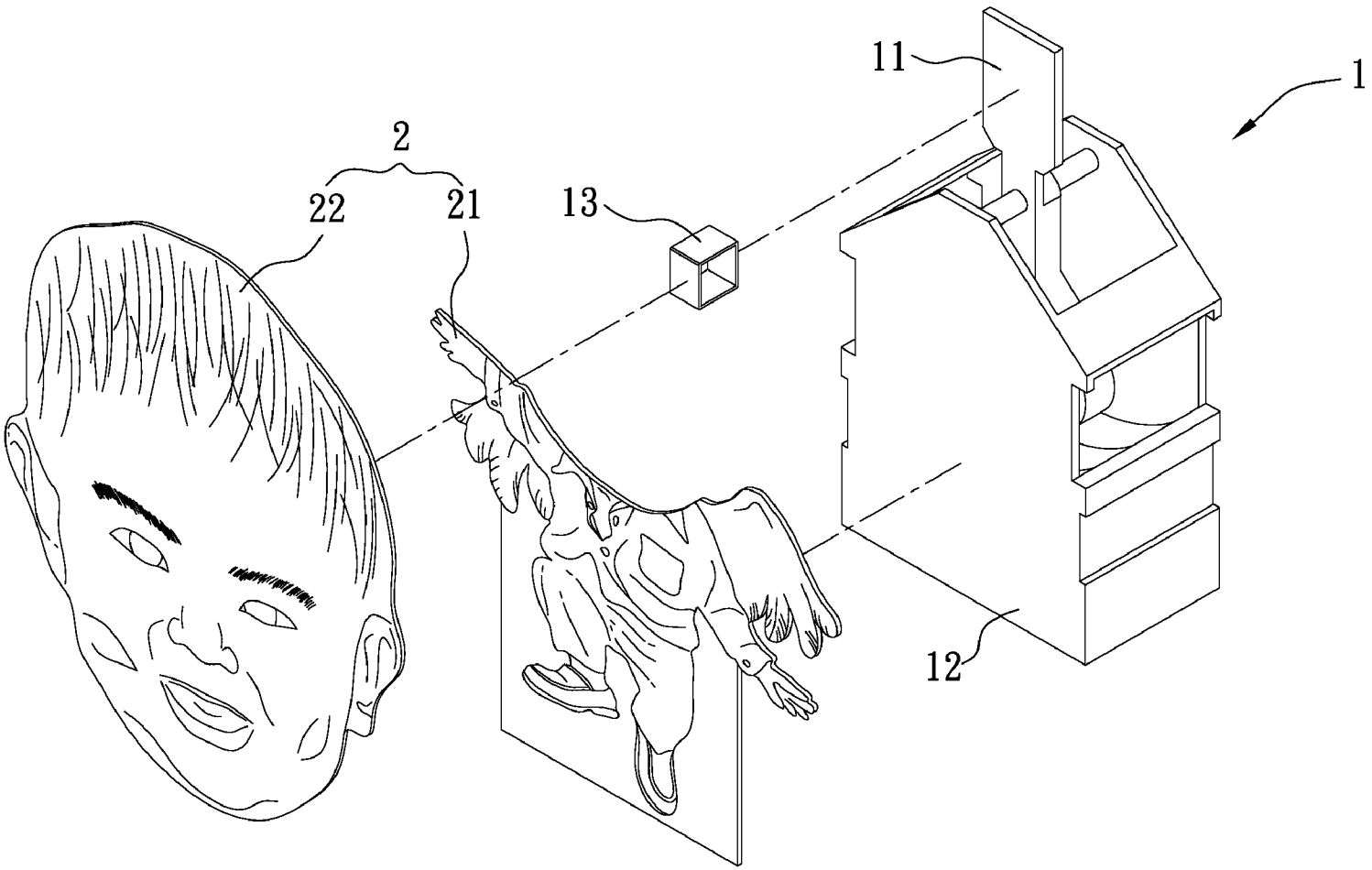
Fig.1 (Prior Art)
FIG. 1 is an exploded perspective view of the conventional rocking head picture display device.
Figure 2:
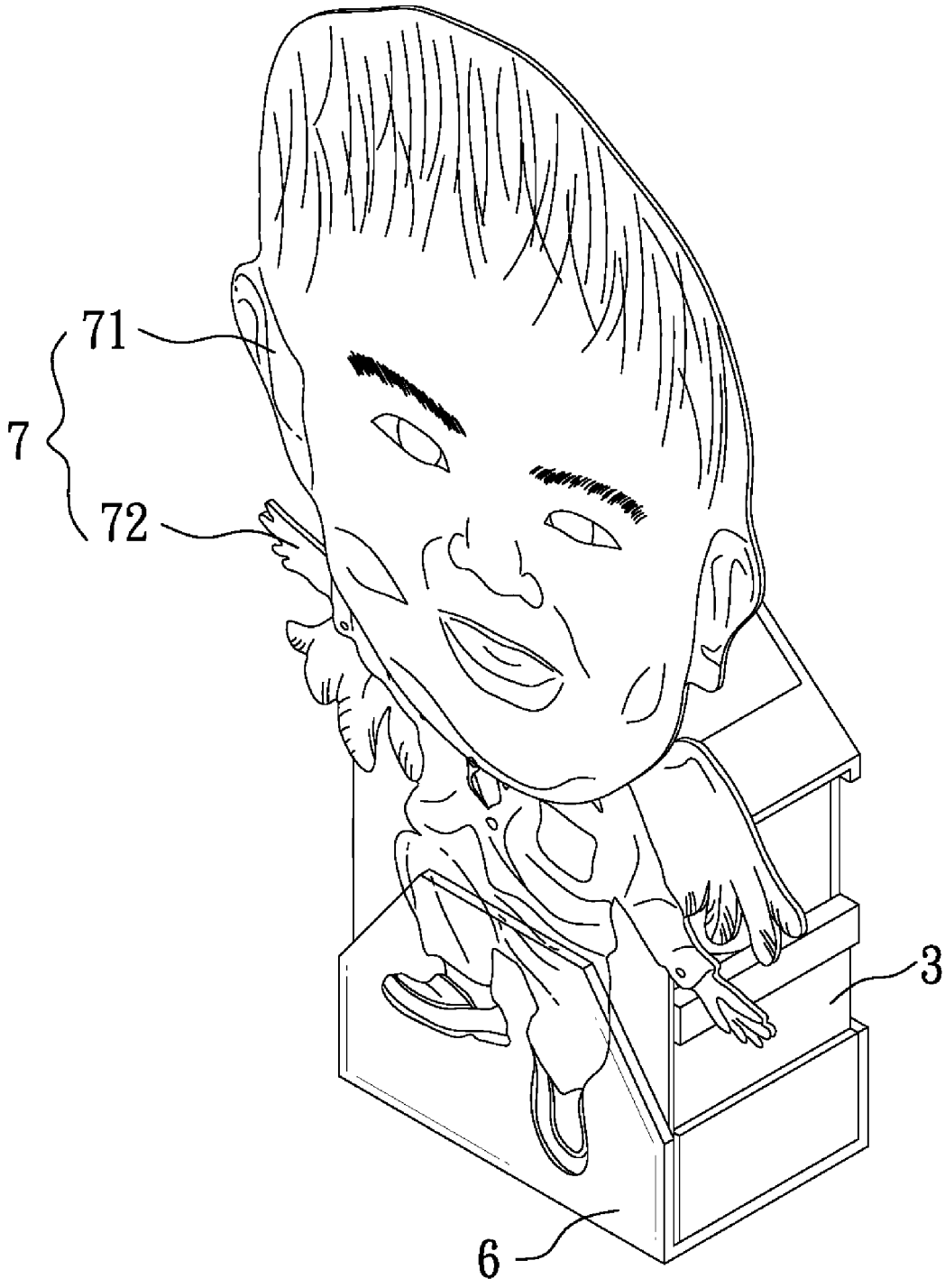
FIG. 2 is a perspective view of a rocking head picture display device in accordance with the present invention.
Figure 3:
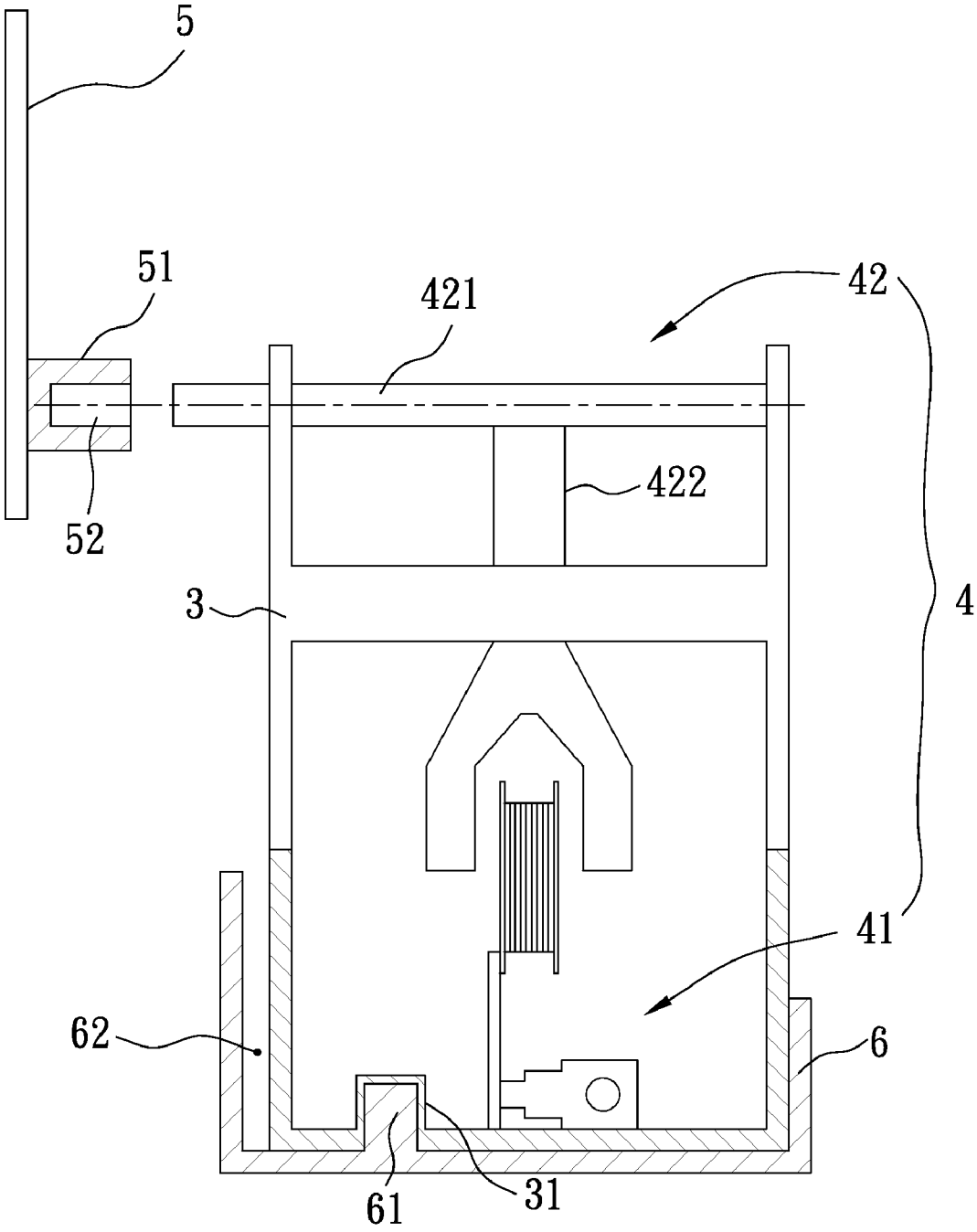
FIG. 3 is a side cross-sectional view of the rocking head picture display device shown in FIG. 2.
Figure 4:
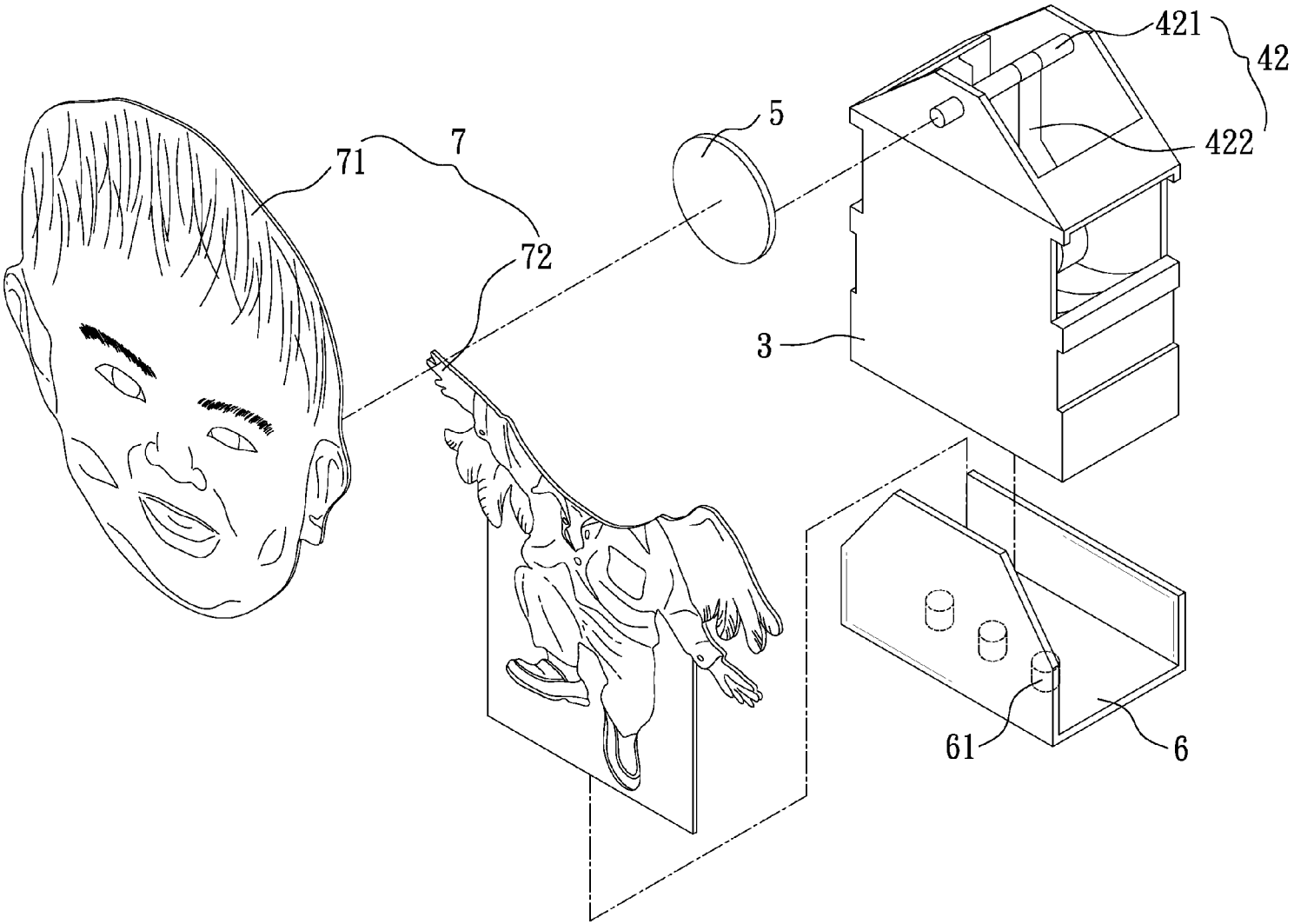
FIG. 4 is an exploded perspective view of the rocking head picture display device shown in FIG. 2.

Referring to FIGS. 2-4, a rocking head picture display device of the first embodiment in accordance with the present invention comprises a house shaped casing (3), a rocking assembly (4) received in the casing (3), a plate shaped connector (5) detachably joined to the rocking assembly (4), a channel shaped base (6) mounted to the bottom of the casing (3), and a picture (7) respectively joined to the base (6) and the connector (5).

It can be seen in FIGS. 3 and 4 that the casing (3) has a bottom with multiple inward locating nests (31) at the bottom of the casing (3) spacing apart an equal distance from each other corresponding to multiple upward extending projections (61) disposed at the base 6 such that the protrusions 61 are capable of fitting with the nests 31 respectively.

FIG. 3 shows the rocking assembly (4) includes an electromagnetic device (41) mounted to the bottom of the casing (3) and a rocking device (42) mounted to the top of the casing (3) right above the electromagnetic device (41). In the preferred embodiment of the present invention, the electromagnetic device (41) is capable of generating an electromagnetic force to induce the rocking device (42). FIGS. 3 and 4 show the rocking device (42) includes a pivotal shaft (421) disposed at the top part of the casing (3) and supported by the front side and the rear side of the casing (3). A rocking arm (422) extends downward from the pivotal shaft (421) to correspond to the electromagnetic device (41) with the lower forked end of the rocking shaft embracing the electromagnetic device (42) such that the rocking arm (422) is capable of swinging due to the induction of the electromagnetic device (42) when the electromagnetic device (42) is powered on. As a result, the swinging rocking arm (422) causes the pivotal movement of the pivotal shaft (421). The pivotal shaft (421) has an end extending outward the front side of the casing (3) for being attached to the plate shaped connector (5).

Referring to FIG. 3 again, a stub (51) with a bore (52) is eccentrically disposed at the back side of connector (5) extends toward the front side of the casing (3) for the bore (52) fitting with the outward end of the pivotal shaft (421).

The channel shaped base (6) shown in FIGS. 3 and 4 is made of transparent material. As it is said previously, the base (6) has a U-shaped cross section with the bottom thereof having the projections (61) fitting with the inner nests (31) at the bottom of the casing (3). The base (6) has a high lateral side and a short lateral side and a distance between the two lateral sides is greater than the distance between front side and the rear side of casing (3). Hence, a locating groove (62) is formed between the high lateral side of the base (6) and the front side of the casing (3) after the base (6) is joined to the bottom of the casing (3). It is noted that the connector 5 is disposed farther from the front side of the casing (3) than the locating groove (62)

Figure 5:
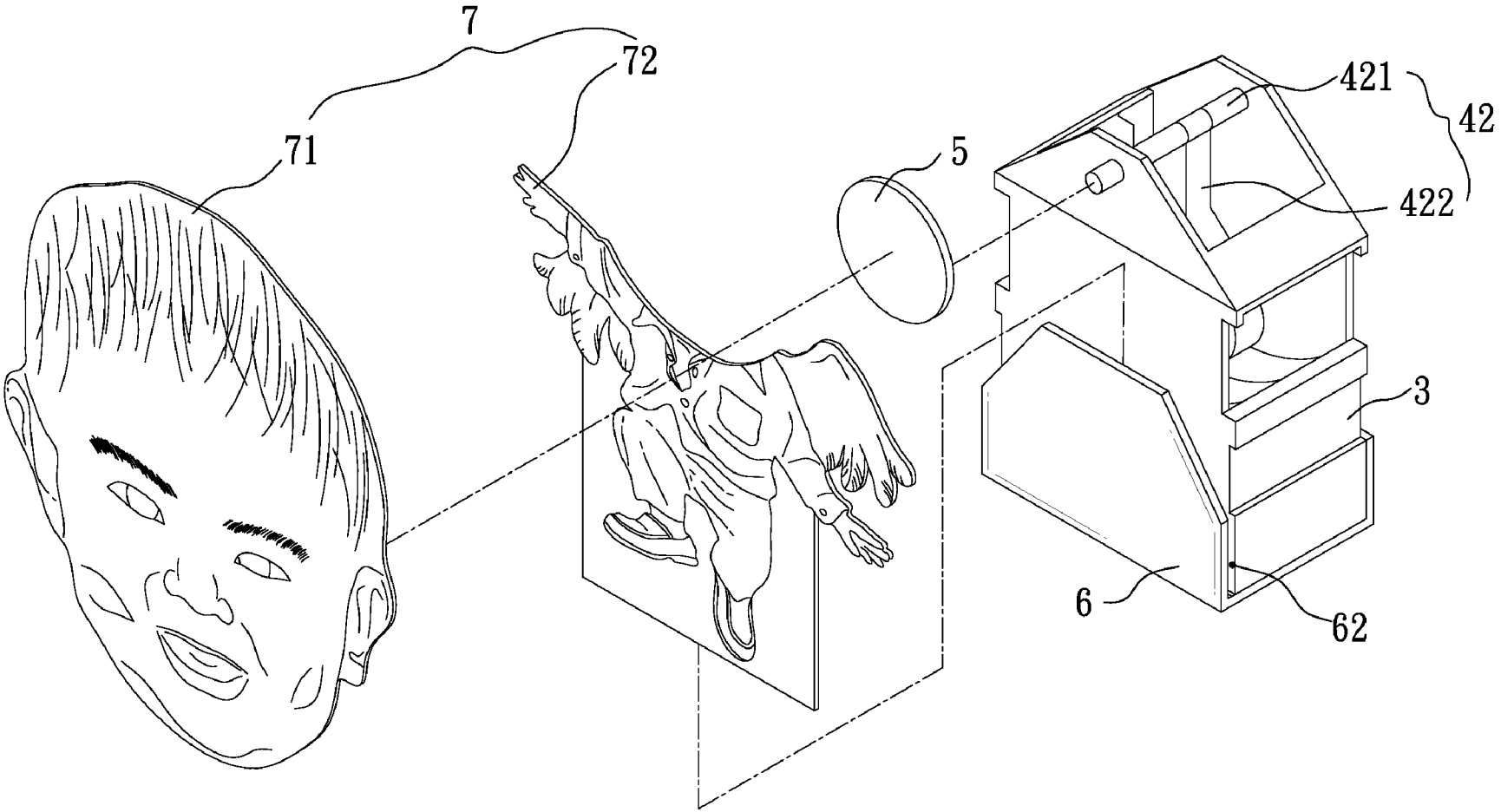
FIG. 5 is another exploded perspective view of the rocking head picture display device shown in FIG. 2 illustrating the base mounted to the casing of the present invention.
Figure 6:
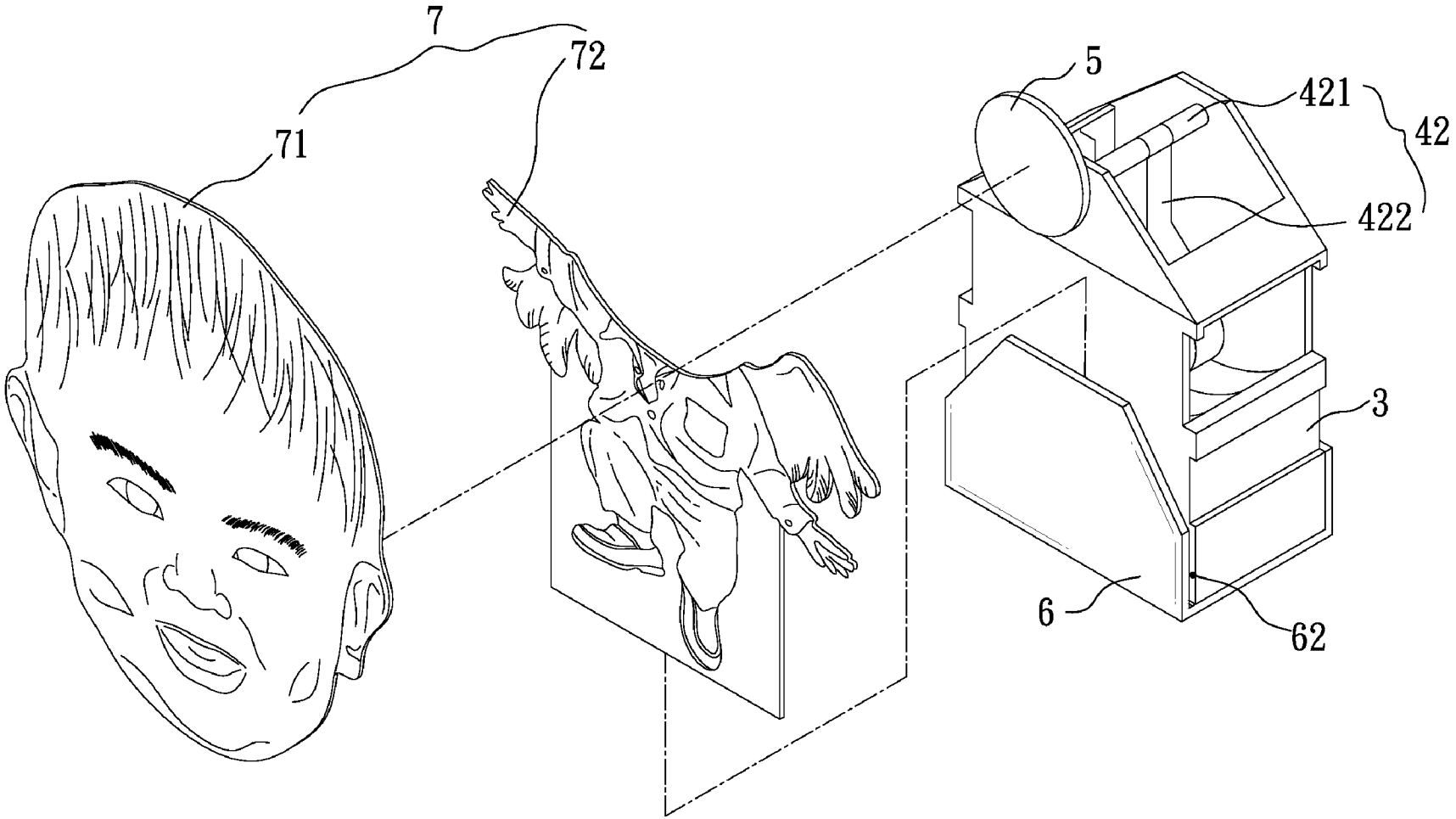
FIG. 6 is a further exploded perspective view of the rocking head picture display device shown in FIG. 2 illustrating a plate shaped connector being joined to the pivotal shaft at the top of the casing in addition to the base assembled to the casing.

The picture (7) as shown in FIGS. 4 to 6 has a head portion (71), which is attached to the outer side of the connector (5) and a body portion (72), which has a straight lower edge resting in the locating groove (62). When the pivotal shaft (421) moves with the swinging rocking arm 422, the connector 5 with the head portion 71 oscillates eccentrically.

Figure 7:
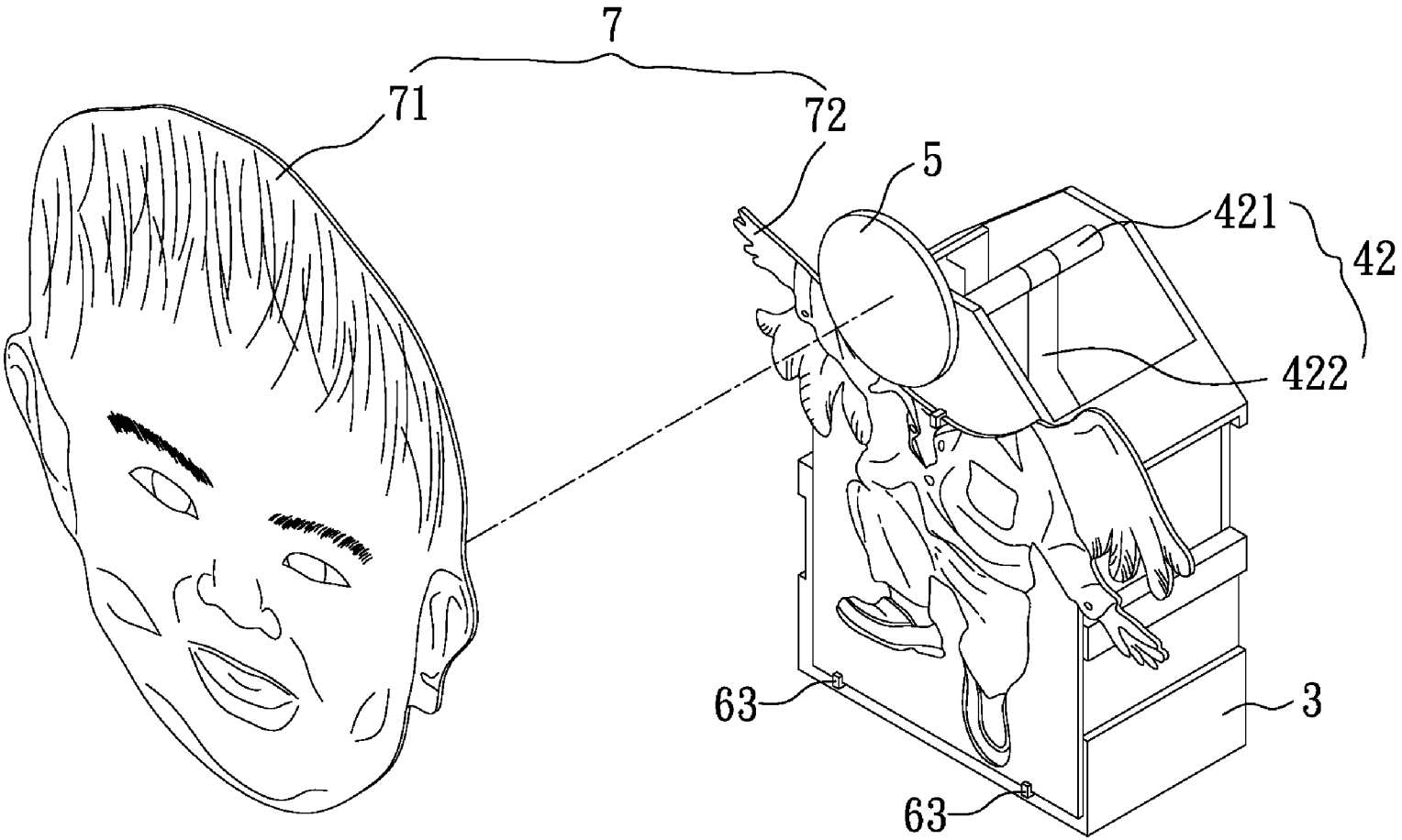
FIG. 7 is a partly disassembled perspective view of the second embodiment of the rocking head picture display device in accordance with the present invention.

With reference to FIG. 7, the second embodiment of the picture display device in accordance with the present invention is illustrated. The difference of the second embodiment from the first embodiment is in that no base is provided at the bottom of the casing (3) and multiple locating hooks (63) are provided at the bottom of the front side of the casing (3) for engaging the straight lower side of the body portion (72).

Figure 8:
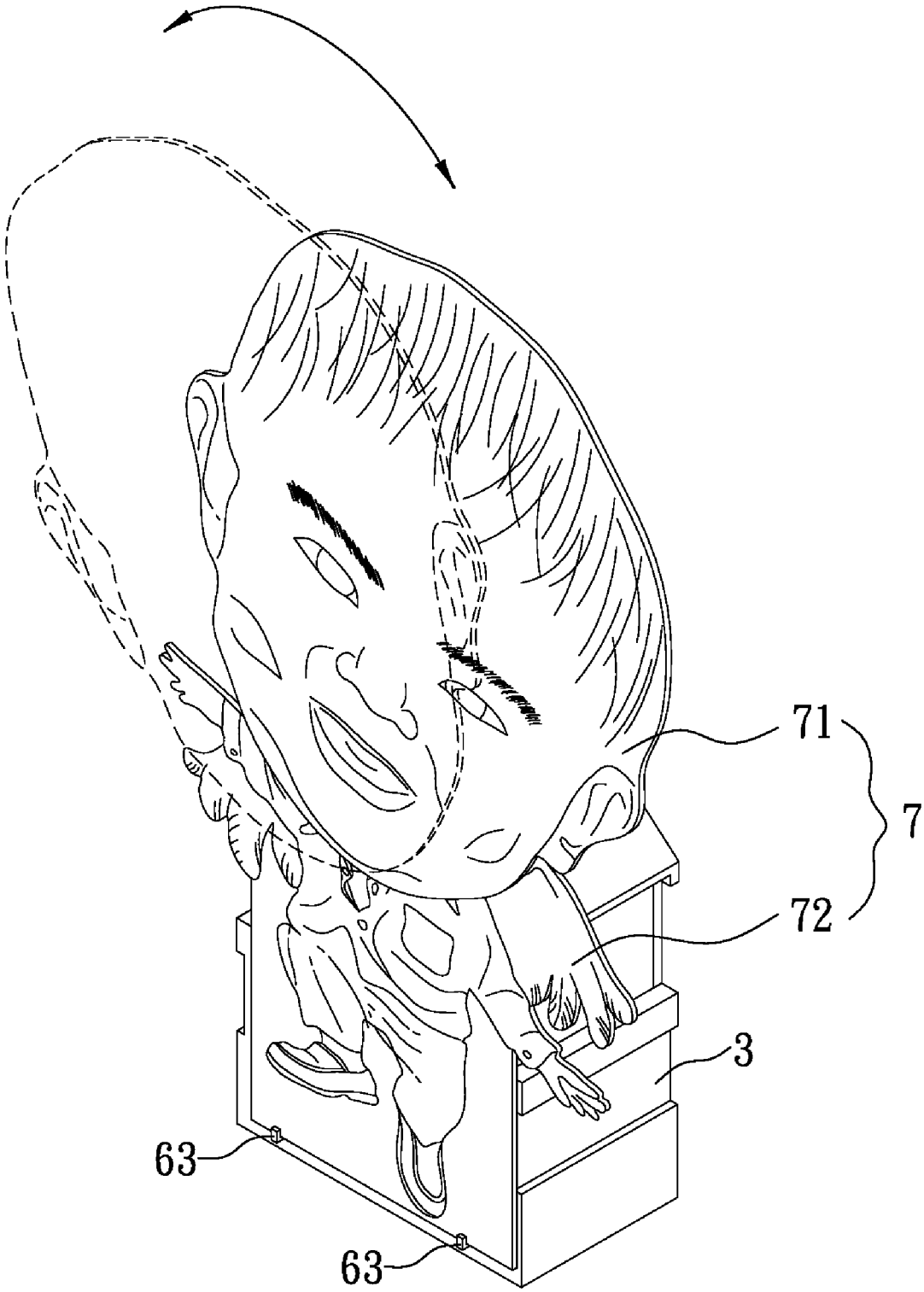
FIG. 8 is a perspective operational view of the rocking head picture display device in accordance with the present invention.

With reference to FIG. 8, when the electromagnetic device (41) is power on, the rocking device (42) is induced to swing with the connector (5) synchronously while the body portion (72) keeps stationary.

As the description above, the rocking head picture display device in accordance with the present invention has the following advantages:

1. The connector (5) can be easily removed from the outer end of the pivotal shaft (421) such that the rocking device (42) and the connector (5) would not be broken when the rocking head picture display is packaged or delivered.

2. The body portion (72) of the picture is replaceable easily based on the preference of the user.

Although the invention has been explained in relation to its preferred embodiment, it is to be understood that many other possible modifications and variations can be made without departing from the spirit and scope of the invention as hereinafter claimed.

What is claimed is:

1. A rocking head picture display device comprising:

a casing with a top, a bottom, a front side and a rear side having a plurality of inward locating nests spacing part a distance from each other at said bottom;

a rocking assembly arranged in said casing further comprising an electromagnetic drive mounted to said bottom and a rocking device mounted to said top and supported with said front side and said rear side in a way of said rocking device corresponding to said electromagnetic device, wherein said rocking device has a pivotal shaft with an outer end extending through said front side and a rocking arm extending downward from said pivotal shaft with a lower end of said rocking arm disposed next to said electromagnetic device;

a circular plate shaped connector with a facial side and a back side having a stub with a locating hole eccentrically disposed at said back side, wherein said locating hole fits with said outer end;

a channel shaped base with a first lateral wall, a second lateral wall and a lower side disposed under said casing having a plurality of locating projections at said lower side corresponding to said locating nests such that when said base is assembled to said casing, said projections fit with said nests, a locating groove is formed between said first lateral wall and said front side, and said second lateral side contacts said rear side; and a picture having a head portion adhered to said facial side and a body portion resting in said locating groove.

2. A rocking head picture display device comprising:

a casing with a top, a bottom, a front side and a rear side having a plurality of locating nests spacing part a distance from each other at said bottom and having a plurality of locating hooks disposed at an intersection of said bottom and said front side;

a rocking assembly arranged in said casing, further comprising an electromagnetic drive mounted to said bottom and a rocking device mounted to said top and supported with said front side and said rear side in a way of said rocking device corresponding to said electromagnetic device, wherein said rocking device has a pivotal shaft with an outer end extending through said front side and a rocking arm extending downward from said pivotal shaft with a lower end of said rocking arm disposed next to said electromagnetic device;

a circular plate shaped connector with a facial side and a back side having a stub with a locating hole eccentrically disposed at said back side, wherein said locating hole fits with said outer end; and a picture having a head portion adhered to said facial side and a body portion with a straight lower edge being held by said locating hooks.

* * * * *